US010967392B2

(12) United States Patent
Dodd

(10) Patent No.: US 10,967,392 B2
(45) Date of Patent: Apr. 6, 2021

(54) HOSE END SPRAYER WITH TRIGGER OPERATED BALL VALVE

(71) Applicant: Silgan Dispensing Systems Corporation, Grandview, MO (US)

(72) Inventor: Joseph K. Dodd, Lee's Summit, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 29 days.

(21) Appl. No.: 15/682,633

(22) Filed: Aug. 22, 2017

(65) Prior Publication Data

US 2018/0056310 A1 Mar. 1, 2018

Related U.S. Application Data

(60) Provisional application No. 62/378,442, filed on Aug. 23, 2016.

(51) Int. Cl.

| | |
|---|---|
| ***B05B 7/24*** | (2006.01) |
| ***B05B 12/00*** | (2018.01) |
| ***B05B 7/12*** | (2006.01) |
| ***B05B 1/26*** | (2006.01) |
| ***B05B 1/16*** | (2006.01) |
| ***B05B 7/00*** | (2006.01) |
| *B05B 1/30* | (2006.01) |

(52) U.S. Cl.

CPC ..... *B05B 7/2443* (2013.01); *B05B 1/1654* (2013.01); *B05B 1/267* (2013.01); *B05B 7/0087* (2013.01); *B05B 7/1209* (2013.01); *B05B 12/002* (2013.01); *B05B 1/3026* (2013.01)

(58) Field of Classification Search

CPC ..... B05B 7/2443; B05B 1/1654; B05B 1/267; B05B 7/1209; B05B 12/002; B05B 1/3026; B05B 7/04; B05B 7/30; B05B 7/0087

USPC ..... 239/318

See application file for complete search history.

(56) References Cited

U.S. PATENT DOCUMENTS

| | | | | | |
|---|---|---|---|---|---|
| 630,468 | A * | 8/1899 | Quayle | B05B 3/04 | 239/383 |
| 2,760,820 | A * | 8/1956 | Cirese | A01C 23/042 | 137/268 |
| 2,887,272 | A * | 5/1959 | Rosenthal | A01C 23/042 | 222/402.12 |
| 3,099,394 | A * | 7/1963 | Lynn | A01C 23/042 | 239/142 |
| 3,104,823 | A * | 9/1963 | Hayes | A01C 23/042 | 137/599.12 |
| 3,164,114 | A * | 1/1965 | Whitman | B23K 9/035 | 228/213 |
| 4,527,740 | A * | 7/1985 | Gunzel, Jr. | B05B 7/2443 | 239/318 |
| 5,881,955 | A * | 3/1999 | Styne | B05B 7/1209 | 239/310 |

(Continued)

*Primary Examiner* — Chee-Chong Lee

(74) *Attorney, Agent, or Firm* — Barlow, Josephs & Holmes, Ltd.

(57) ABSTRACT

A trigger sprayer is described which utilizes a ball valve to control the flow of a carrier fluid such as water. The ball valve is actuated by a trigger which is biases to the open position by a torsion spring. Provision is made for the trigger sprayer to draw a chemical solution from a supply container and meter it through one or more outlet devices for providing streams in the form of fan or mist sprays, or other shaped sprays.

11 Claims, 8 Drawing Sheets

(56) References Cited

U.S. PATENT DOCUMENTS

2008/0061167 A1* 3/2008 Gansebom ..... B05B 1/1654
239/394

* cited by examiner

HOSE END SPRAYER WITH TRIGGER OPERATED BALL VALVE

CROSS-REFERENCE TO RELATED APPLICATIONS

This Application claims the benefit of U.S. Provisional Patent Application No. 62/378,442, filed Aug. 23, 2016, the entire contents of which are incorporated herein by reference.

BACKGROUND OF THE INVENTION

Field of the Invention

Various embodiments of the present invention relate to trigger-operated hose-end sprayers useful for applying solutions such as cleaning agents, fertilizer, weed and pest control substances, and other chemicals that are typically provided in disposable containers for household or industrial applications.

Description of the Related Art

Every year consumers apply thousands of gallons of chemicals such as fertilizers or pesticides to plants, lawns, flowers, vegetable gardens and other organic type vegetation. Typically, such chemicals are sold in plastic containers in a concentrated form. While in this concentrated form, some of these chemicals are hazardous to the consumer end user and the environment in general. Accordingly, the container typically includes an aspiration-type sprayer head assembly. An aspiration-type sprayer uses a relatively large amount of carrier fluid, such as water, to withdraw, dilute and dispense a relatively small amount of chemical from the container. To further prevent harm to the consumer, the container and the sprayer head assembly are preferably disposed of after the container's contents are exhausted. It is therefore desirable to provide a sprayer head assembly that is sufficiently low cost so as to allow the entire unit to be discarded and yet reliable and safe. Alternately, it may be desirable to provide a sprayer head assembly that is relatively low cost, but sturdy enough for repeated use at least for a limited duration, such as one gardening season, before disposed of at the end of the year.

In some applications, it is desirable to use a sprayer head assembly to selectively apply the chemical/carrier mixture and the carrier fluid to a surface. For example, the chemical/carrier mixture may form a cleaning solution, which is rinsed away by the carrier fluid. Such a sprayer head assembly is particularly useful for cleaning surfaces that cannot be physically reached by the user but can be reached by the spray generated by the sprayer head assembly. Commonly assigned U.S. Pat. No. 7,350,722, which is incorporated by reference herein in its entirety, describes a sprayer head assembly. However, this sprayer head assembly lacks any carrier fluid flow control. Commonly assigned U.S. Pat. No. 7,513,442, which is incorporated by reference herein in its entirety, describes another sprayer head assembly, but its lever-actuated carrier fluid control valve would usually require two hands for operation.

SUMMARY OF THE INVENTION

According to certain embodiments of the invention, there is provided a safe and reliable aspiration type hose-end sprayer that enables a choice of operation modes, and provides a carrier fluid flow control valve suitable for one-hand use.

According to various embodiments of the invention the hose-end sprayer may include a carrier fluid inlet connection; a carrier fluid flow control valve downstream of the carrier fluid inlet connection; a lever that rotates the carrier fluid flow control valve, the lever and carrier fluid flow control valve being biased into a closed position by a spring; and an outlet selector valve downstream of the carrier fluid flow control valve.

Accordingly, one embodiment of the invention involves a chemical sprayer that includes a hose end sprayer and a container. The container defines a cavity for storing a chemical to be sprayed. The hose end sprayer may include a chemical passage, a carrier fluid passage, a selector valve chamber and a selector valve. The chemical passage may be in communication with the cavity. The carrier fluid passage may be in communication with a carrier fluid source. Both the carrier fluid and chemical passages may be in communication with the selector valve chamber. The selector valve may be moveably positioned within the selector valve chamber and may at least partially define a first passage and a second passage. The first passage may be configured to be in communication with the chemical passage when the selector valve is in a first open position. The second passage may be configured to be in communication with the chemical fluid passage when the selector valve is in a second open position. The first and second passages may also be configured not to be in communication with the chemical fluid passage when the selector valve is in a closed position. The selector valve may include one or more seal portions to block or prevent leakage of either the chemical or the carrier fluid passages when the selector valve is in its various positions. The seal portions may include a seal portion that selectively provides a vent passage to vent the container to the atmosphere.

Another aspect of the invention involves a selector valve having a suction generating surface that may communicate with one or both of the first and second passages in their open positions. A suction generating surface may be positioned and configured such that the flow of carrier fluid over the suction generating surface may create a suction that draws chemical through the chemical passage and into the selected one of the first and second passages. A suction generating surface may be located proximate a metering orifice to control the ratio of chemical to carrier fluid.

Yet another aspect of the invention involves a carrier fluid passage is in communication with a carrier fluid source. A carrier valve may be positioned in the carrier fluid passage to control selectively turn the carrier fluid flow on or off, and optionally to control the rate at which the carrier fluid flows through the sprayer. The carrier valve may be a ball valve and may be actuated by a trigger. The trigger may be biased toward an off position by a torsion spring molded in a unitary piece with the trigger, or otherwise bearing against the trigger.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

DETAILED DESCRIPTION

Figure 1:
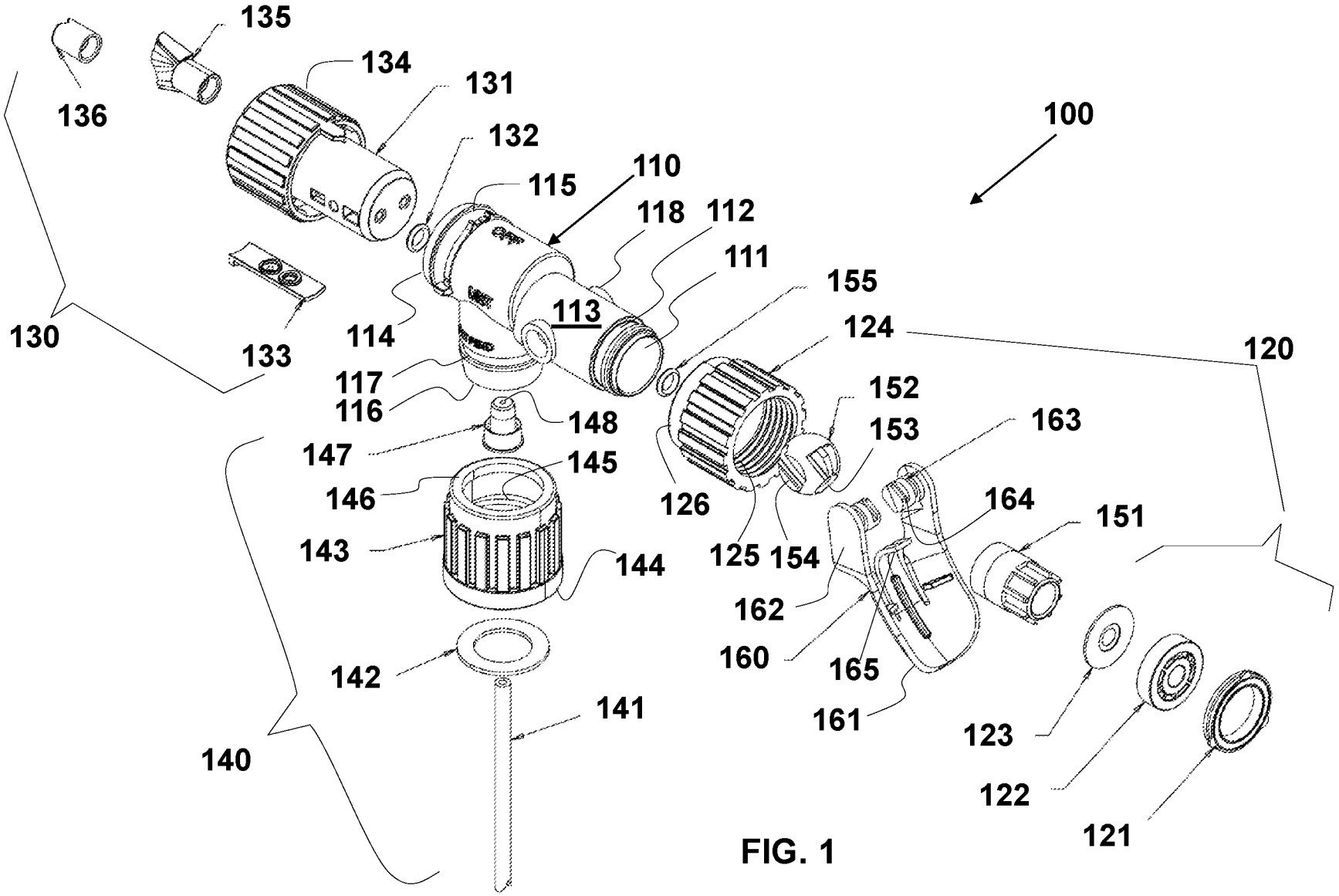
FIG. 1 illustrates an exploded perspective view of a hose end sprayer according to various embodiments of the invention.

FIG. 1 illustrates a hose end sprayer 100 which will be described as several subsections including a sprayer housing 110, a carrier fluid inlet assembly 120, an outlet assembly 130, a closure assembly 140, and a carrier fluid valve system including among other elements a ball valve 152 and a trigger 160. The carrier fluid valve system is located downstream from the carrier fluid inlet assembly 120 (with respect to the carrier fluid flow), and the outlet assembly 130 is located downstream from the carrier fluid valve system.

A sprayer housing 110 according to various embodiments of the invention may include a housing inlet 111, a housing inlet connection 112, a housing body 113, a housing outlet 114, a housing outlet connection 115, a housing chemical inlet 116, a housing chemical inlet connection 117, and a pair of valve axle ports 118.

Carrier fluid inlet assembly 120 may include a gasket 121 (such as a hose washer or similar), a plate regulator 122, and an elastomeric valve 123. Plate regulator 122 and elastomeric valve 123 may serve as an anti-siphon device to prevent carrier fluid from going backwards into the carrier fluid supply. Carrier fluid inlet assembly 120 may further include a hose closure 124 with internal threads 125 and a hose closure snap connection 126 to fit onto the housing inlet 111. In certain embodiments, the internal threads 125 may be omitted and a quick-connect or similar alternative connector may be used to attach the carrier fluid inlet assembly 120 to a carrier fluid supply.

Outlet assembly 130 may include a selector valve such as turret valve 131, a turret O-ring 132, a seal pad 133 with one or more seals such as O-rings, a turret valve collar 134 (selector valve collar) adapted for a snap fit onto housing outlet connection 115, a fan spray element 135, and a mist spray element 136. Fan spray element 135 and mist spray element 136 may be optional or may be molded with turret valve 131. Turret valve collar 134 may rotate upon housing 110, in order to move turret valve 131 within housing 110, thereby selectively aligning flow path 171 (FIG. 4) within housing 110 with one or more passageways such as first passageway 172 or second passageway 173 within turret valve 131. There may also be turret valve collar 134 positions in which additional passageway(s) within turret valve 131 are aligned with flow path 171, or in which no selector valve passageways are aligned with flow path 171.

The closure assembly 140 may include a dip tube 141 to draw chemical from a chemical supply container B, a washer or gasket 142, a closure cap 143 with optional internal anti-backoff provisions 144 and internal threads 145, a closure cap snap connection 146 to fit onto housing chemical inlet connection 117, and a dip tube connector 147 including a metering orifice 148. In certain embodiments, internal threads 145 may be omitted and a different connection type such as a snap-on or bayonet connection may be used to connect the closure assembly to a chemical supply container.

The carrier fluid valve system may include a ball valve adapter 151 positioned on the upstream side of a ball valve 152. Ball valve 152 may have a ball valve bore 153 passing therethrough, and a pair of grooves 154 on the sides of the ball valve 152, and may face a ball exit O-ring 155. Ball valve 152 may be spherical over at least a portion of its outer surface, including a portion that contacts the ball exit O-ring 155 in the closed position shown in FIG. 4. The carrier fluid valve assembly may also include a trigger 160 including a trigger lever 161, and a pair of trigger arms 162 each supporting from an inward surface a trigger half-axle 163 with keyways 164 to mate into grooves 154 on ball valve 152. The trigger 160 may also include a spring 165 that may be a torsion spring integrally molded with trigger 160 or trigger lever 161. In other embodiments, the spring 165 may be a separate part, or may be molded as a part of sprayer housing 110. In certain embodiments, trigger 160 may have a single trigger arm 162 with a single half-axle 163 and a keyway 164 engaging a groove 154 on only one side of ball valve 152. In such an embodiment, the second valve axle port 118 may be omitted, or may be a blind recess if a second trigger arm 162 is used with a half-axle 163 that does not connect to the ball valve 152. The use of a spring-biased trigger 160 allows the hose end sprayer to be held and actuated with a single hand. For example, hose end sprayer 100 depicted in FIGS. 1-6 and 8 may be held in one hand and one or more fingers of that hand may pull up on trigger lever 161 to turn on the carrier fluid flow and to modulate the flow rate.

Having described the individual parts in FIG. 1, we turn to the assembled perspective view of the hose end sprayer 100 in FIG. 2, which again enumerates several parts including sprayer housing 110, housing body 113, hose closure 124, selector valve collar 134, dip tube 141, closure cap 143, trigger lever 161, and trigger arms 162.

Figure 3:
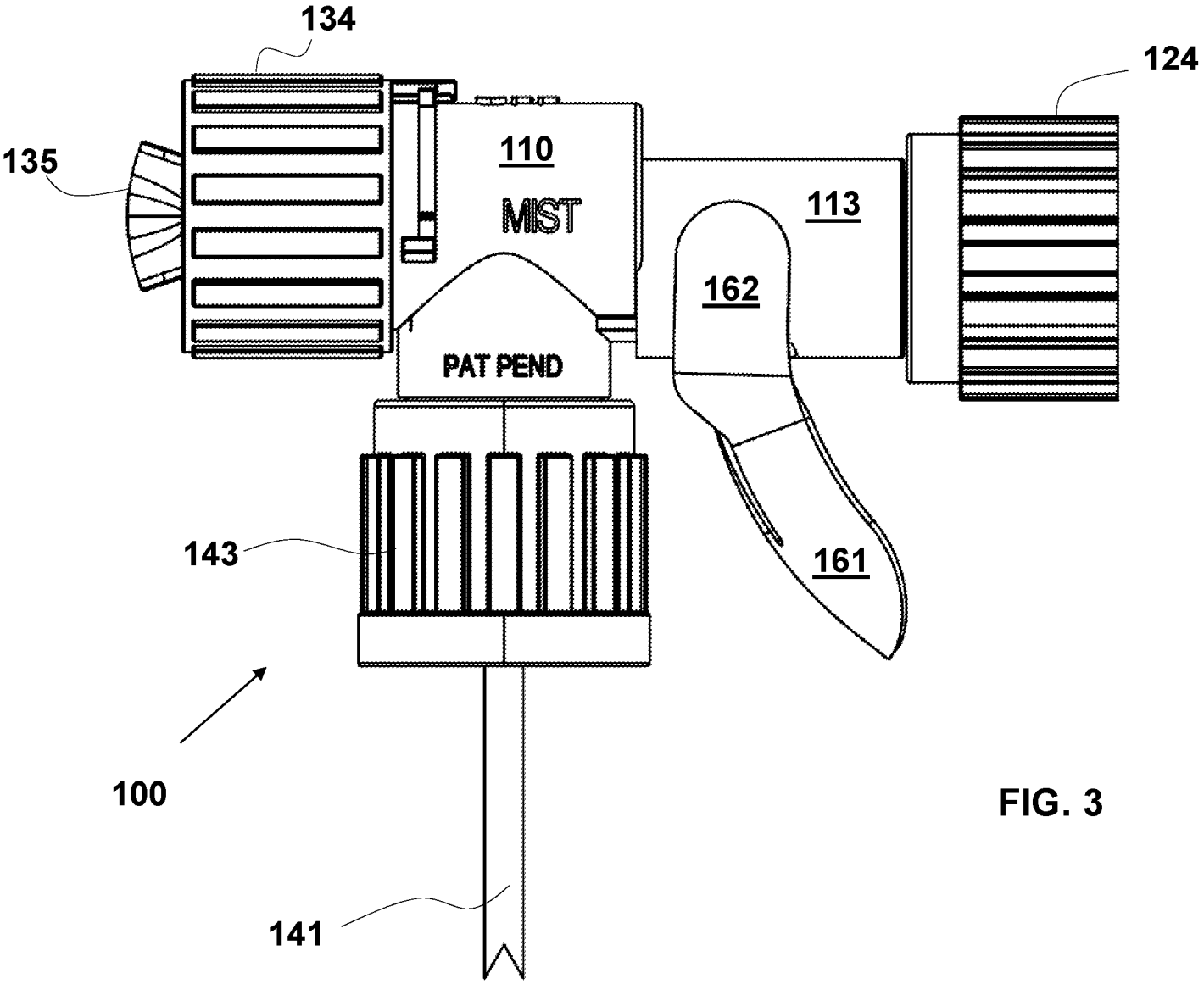
FIG. 3 illustrates an external side view of a hose end sprayer with a carrier fluid valve in a closed position.

FIG. 3 illustrates a side view of hose end sprayer 100, which again enumerates several parts including sprayer housing 110, housing body 113, hose closure 124, selector valve collar 134, dip tube 141, closure cap 143, trigger lever 161, trigger arms 162, and fan spray element 135.

Figure 2:
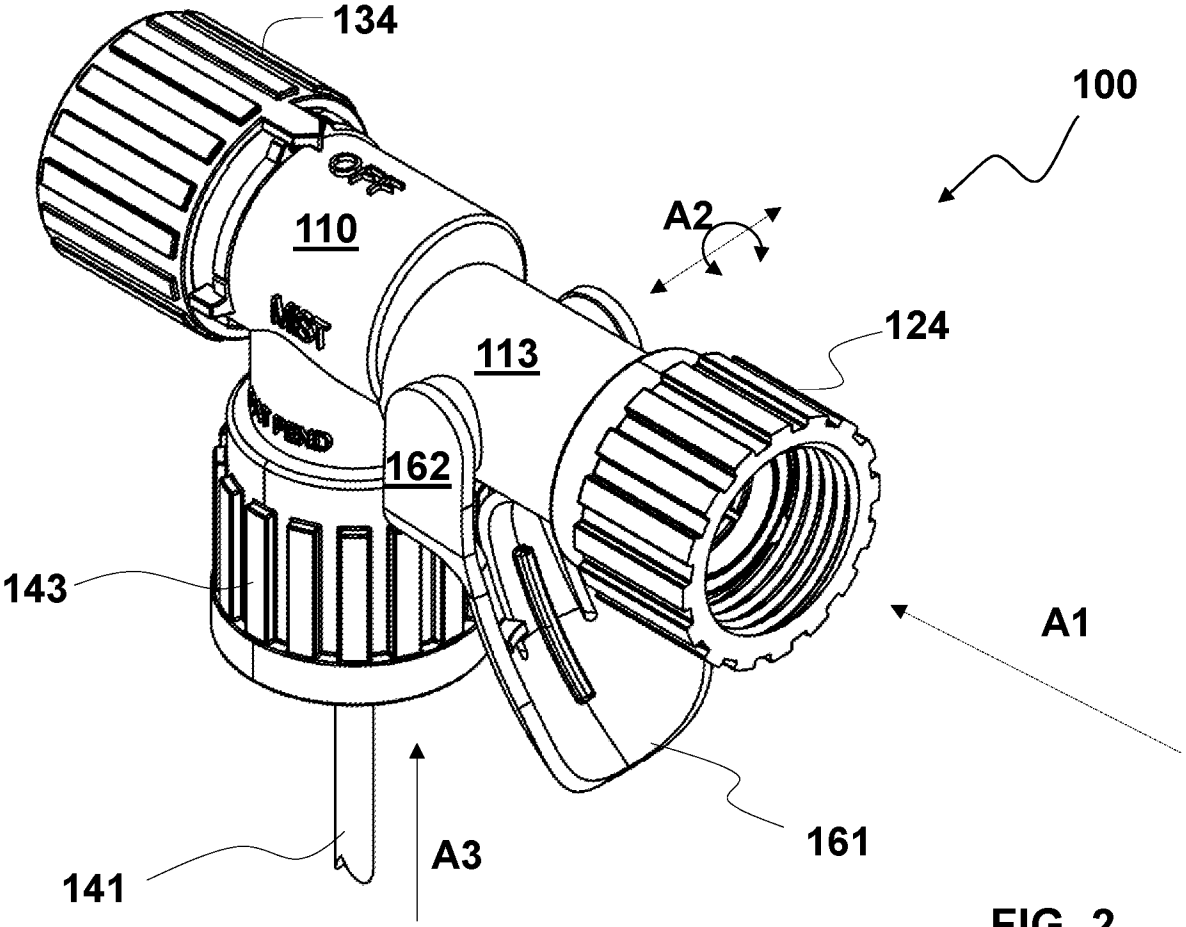
FIG. 2 illustrates a perspective view of the hose end sprayer of FIG. 1, with a carrier fluid valve in a closed position.
Figure 4:
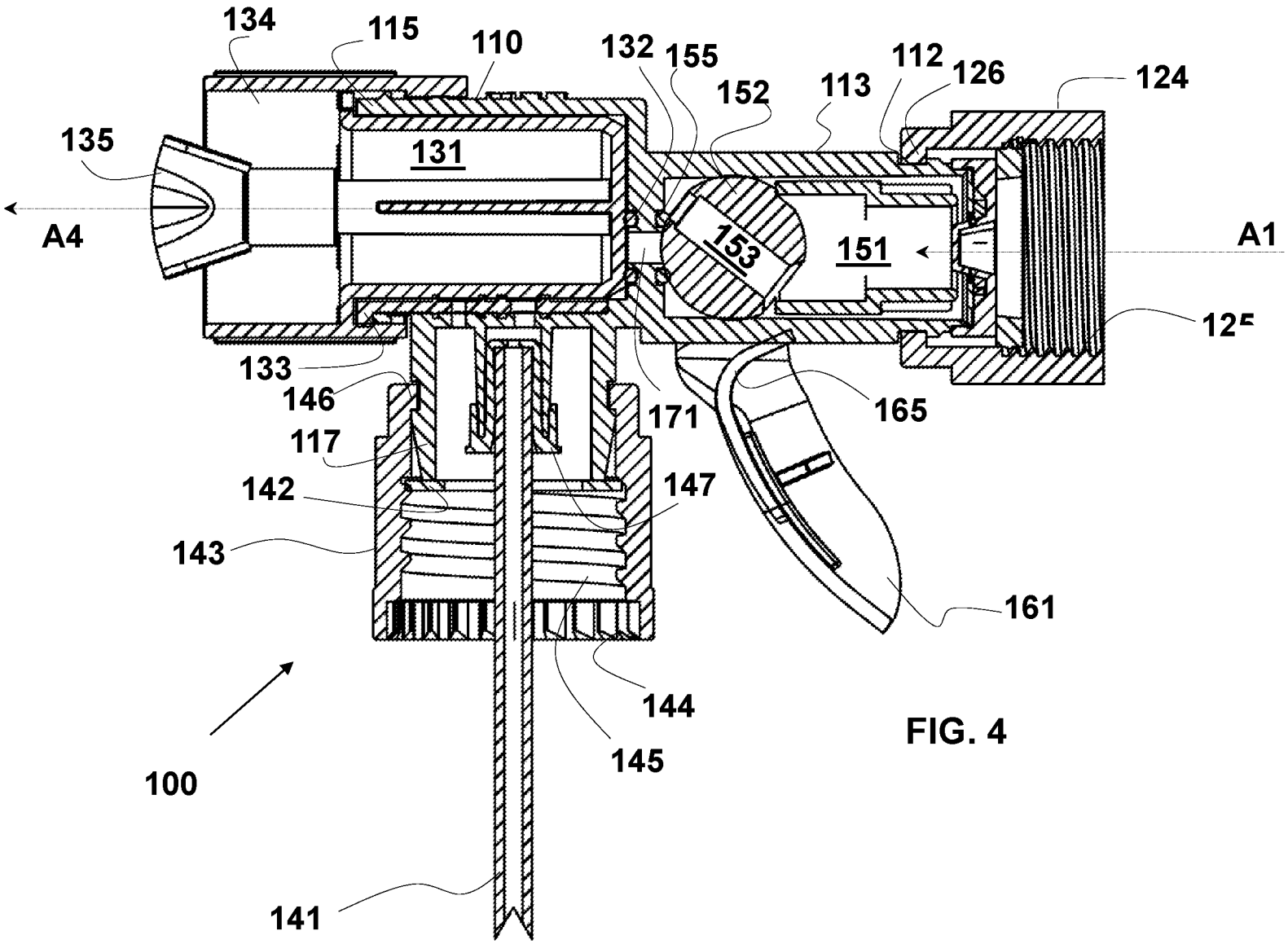
FIG. 4 illustrates a cross-section side view of a hose end sprayer with a carrier fluid valve in a closed position.

FIG. 4 illustrates a cross section side view of hose end sprayer 100. This view, like that of FIGS. 2-3, shows the carrier fluid valve system in a closed configuration. In addition to several elements enumerated in FIGS. 2 and 3, FIG. 4 shows internal threads 125 on hose closure 124, and ball valve adapter 151 on the inlet (right) side of ball valve 152. The ball valve 152 is shown in its closed position, a position to which it is biased by torsion spring 165, whose free end bears against housing body 113. A notch (not shown) may be provided in housing body 113 for receiving the free end of torsion spring 165. Just downstream of ball valve 152 and sealing against ball valve 152 may be first carrier fluid O-ring 155 at an inlet end of ball valve outlet passage 171. On the outlet of passage 171 is a second carrier fluid O-ring 132 may seal against turret valve 131.

As seen in FIG. 4, hose closure 124 may be held on the assembly by a snap fit that engages housing inlet connection 112. Outlet assembly 130 may be held on the assembly by a snap fit that engages housing outlet connection 115. Dip tube 141 may be held within dip tube connector 147. Closure cap 143 may be held on the assembly by closure cap snap connection 146 engaging housing chemical inlet connection 117.

Figure 5:
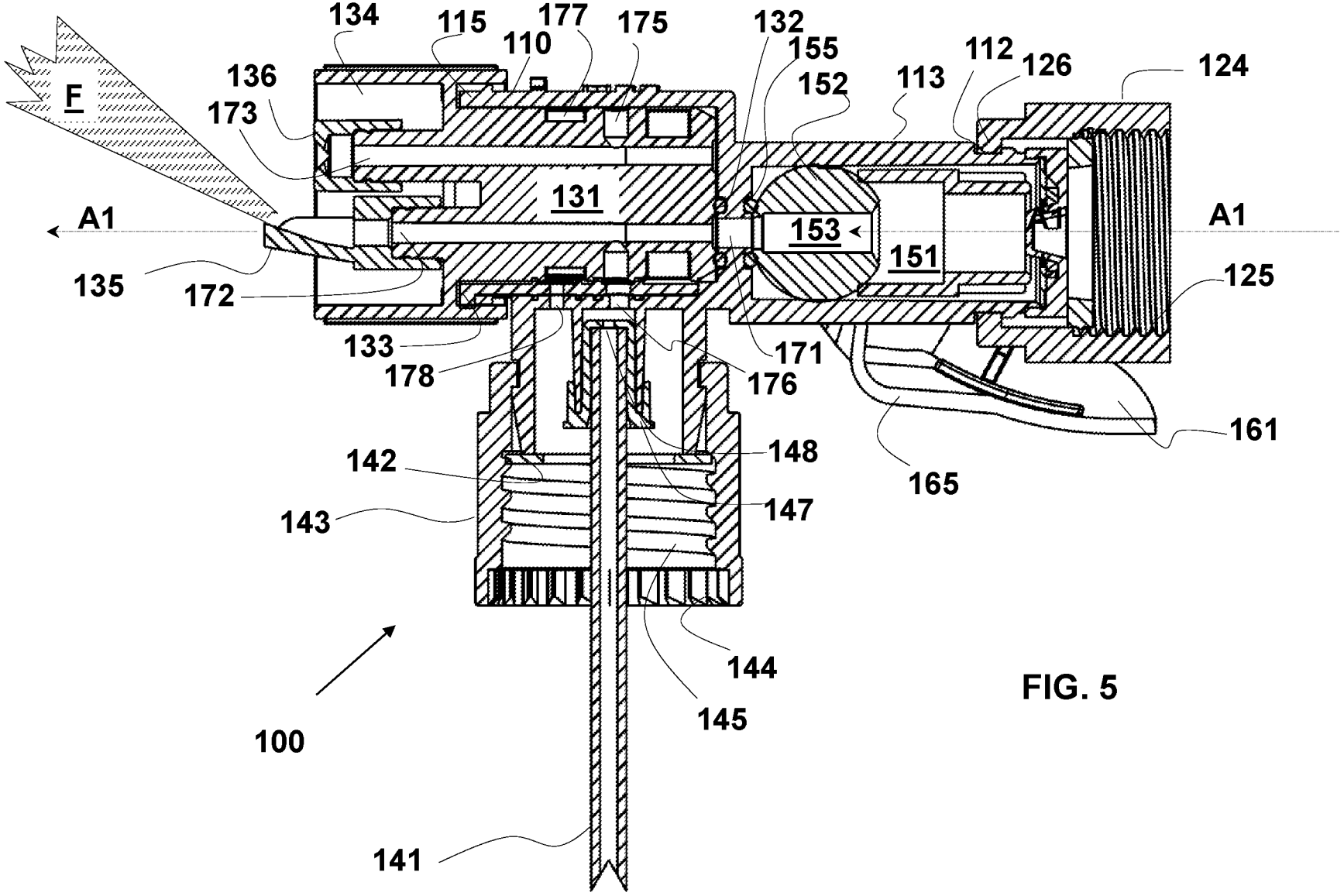
FIG. 5 illustrates a cross-section side view of a hose end sprayer with a carrier fluid valve in an open position, and a selector valve positioned to deliver a fan spray through a first outlet passage.

FIG. 5 repeats the cross-sectional view seen in FIG. 4, except that the carrier fluid valve system is in an open configuration, and outlet assembly 130 has been rotated against the force of the torsion spring 165 to a position where a fan spray F is provided. As is seen in FIG. 5, the path of the carrier fluid is generally linear along a first, horizontal axis A1 (see FIG. 2 and FIGS. 4-6) from housing inlet connection 112, through ball valve 152, and through one of flow passages 172, 173 in turret valve 131. In order that multiple flow passages 172, 173 may be selectively aligned along axis A1, turret valve 131 may rotated about a fourth axis A4 (see FIG. 4) where the fourth axis A4 may be parallel to axis A1 while not collinear with axis A1. Trigger lever 161 has been pulled against torsion spring 165 as that trigger arms 162 each turn their respective half-axle 163 whose keyways 164 (upon assembly) are mated into grooves 154 on ball valve 152. Ball valve 152 thus rotates with trigger 160, bringing ball valve 152 into a position where carrier fluid may move through bore 153 through passage 171 and into first passageway 172, which leads out to fan element 135 producing fan spray F. The rotation of ball valve 152 is seen to be about a second axis A2 that may be horizontal and perpendicular to first axis A1 (see FIG. 2). As the carrier fluid moves through passageway 172 it passes suction port 175 and creates suction that draws chemical up through dip tube 141, through metering orifice 148, and into the carrier fluid stream. Instead of or in addition to metering orifice 148, one or more of suction ports 175 may incorporate a metering orifice so that the ratio of chemical to carrier fluid may be different for flow through different passageways 172, 173. The flow of chemical into turret valve 131 through suction port 175 may be along an axis A3 (see FIG. 2) generally perpendicular to the first axis A1. Vent passage 177 and vent passage 178 may also be provided in or adjacent turret valve 131, to connect the chemical supply container to atmospheric pressure. Seal pad 133 may be provided to help seal the flow paths between the chemical container and the sprayer. Seal pad 133 and/or turret valve 131 may be provided with sealing elements such as O-rings.

Figure 6:
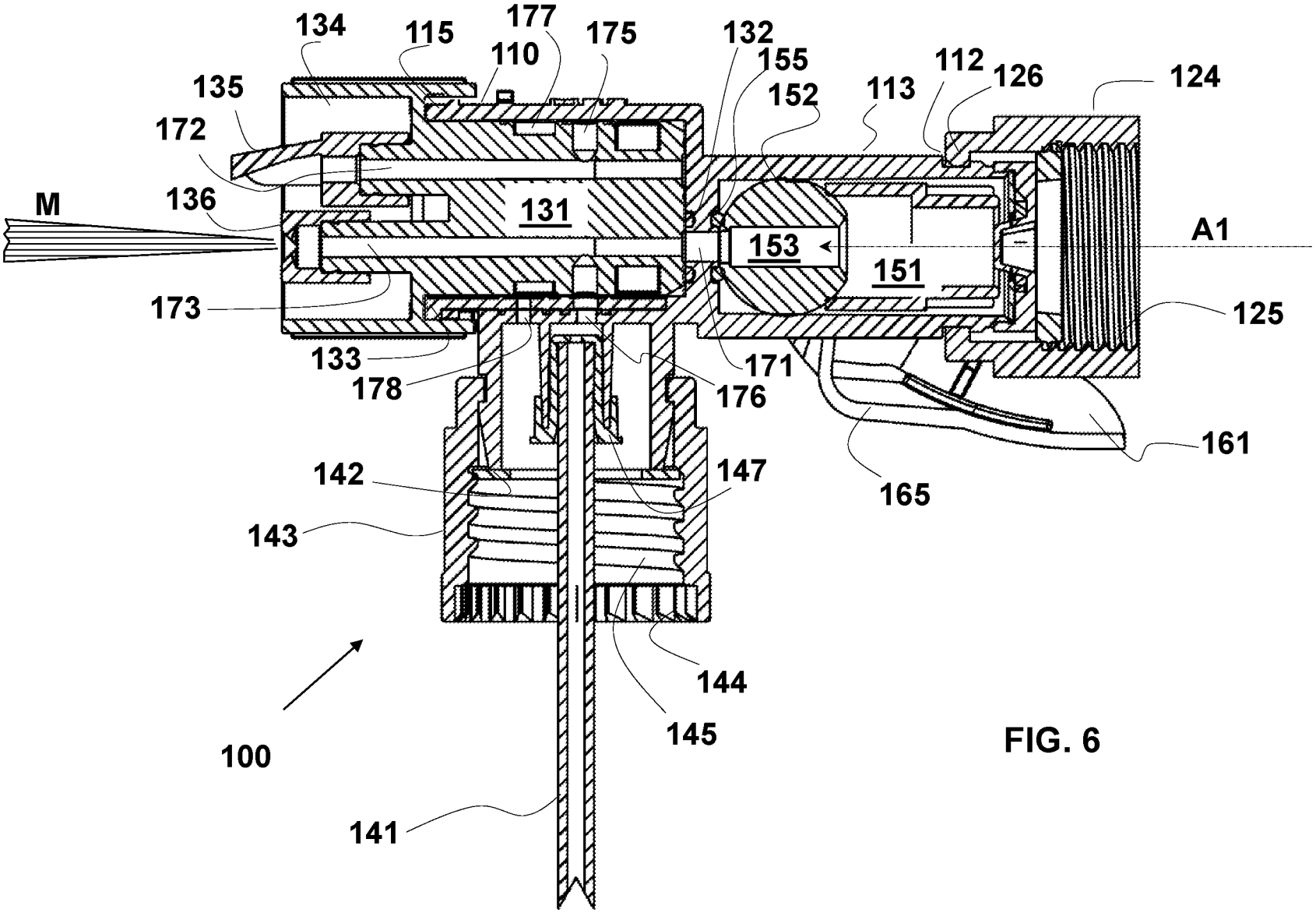
FIG. 6 illustrates a cross-section side view of a hose end sprayer with a carrier fluid valve in an open position, and a selector valve positioned to deliver a mist spray through a second outlet passage.

FIG. 6 repeats the cross-sectional view seen in FIG. 5, again with the carrier fluid valve system is in an open configuration, but now with turret valve 131 rotated to a position where a mist spray M is provided through second passageway 173. The turret valve 131 may rotate about first axis A1, or about an axis A4 parallel to first axis A1. Likewise, first passage 172 and second passage 173 may each be parallel to first axis A1, and capable of being moved into collinear alignment with first axis A1. As the carrier fluid moves through passageway 173 it passes suction port 175 and creates suction that draws chemical up through dip tube 141, through metering orifice 148, through chemical inlet channel 176 and any associated port on seal pad 133, through suction port 175, and into the carrier fluid stream. A vent passage 177, 178 may also be provided in or adjacent to seal pad 133, to connect the chemical supply container to atmospheric pressure.

Although both outlet configurations (fan and mist) shown in FIGS. 5 and 6 respectively have respective first and second passageways 172, 173 connected to the chemical supply, turret valve 131 may be designed so that either of the first and second passageways 172, 173 is not connected to the chemical supply. Alternately, additional passageways may be provided in turret valve 131, for example additional passageway(s) that provide only the carrier fluid and no chemical to the outlet of the hose end sprayer.

Figure 7:
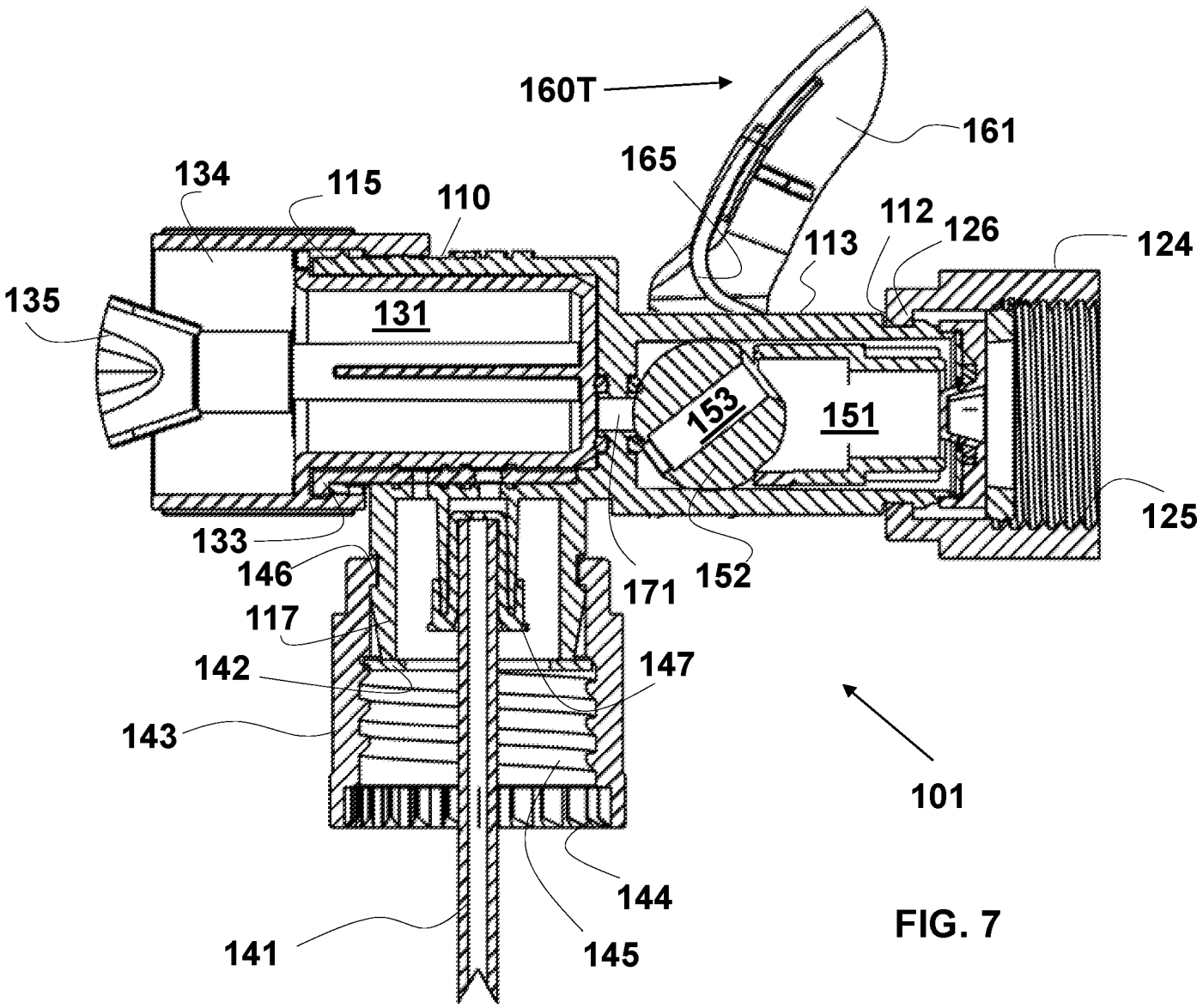
FIG. 7 illustrates a cross-section side view of a hose end sprayer with a different placement of a trigger lever.

As noted above, the use of a spring-biased trigger 160 allows the hose end sprayer to be held and actuated with a single hand. With hose end sprayer 100 discussed thus far, trigger 160 is mounted below the sprayer (e.g. adjacent closure assembly 140) so that one or more fingers of the hand holding the sprayer may pull up on trigger lever 161 to turn on the carrier fluid flow and to modulate the flow rate. In the alternative, as shown in FIG. 7 for hose end sprayer 101, a top-mounted trigger 160T may be mounted above the sprayer (e.g. 180 degrees around from the closure assembly 140), so that a user's thumb or index finger may be used to activate the trigger lever 161. A top-mounted trigger 160T might be produced without altering the position of axle ports 118. In yet another embodiment (not shown), trigger 160 could be mounted on a lateral portion of the trigger sprayer. This might require axle ports 118 to be repositioned, for example 90 degrees around housing body 113 which would permit use of either a 'right-side' (or 'left-side') trigger 160. However, such placement of trigger 160 might be convenient mainly for right-handed (or left-handed) users.

Figure 8:
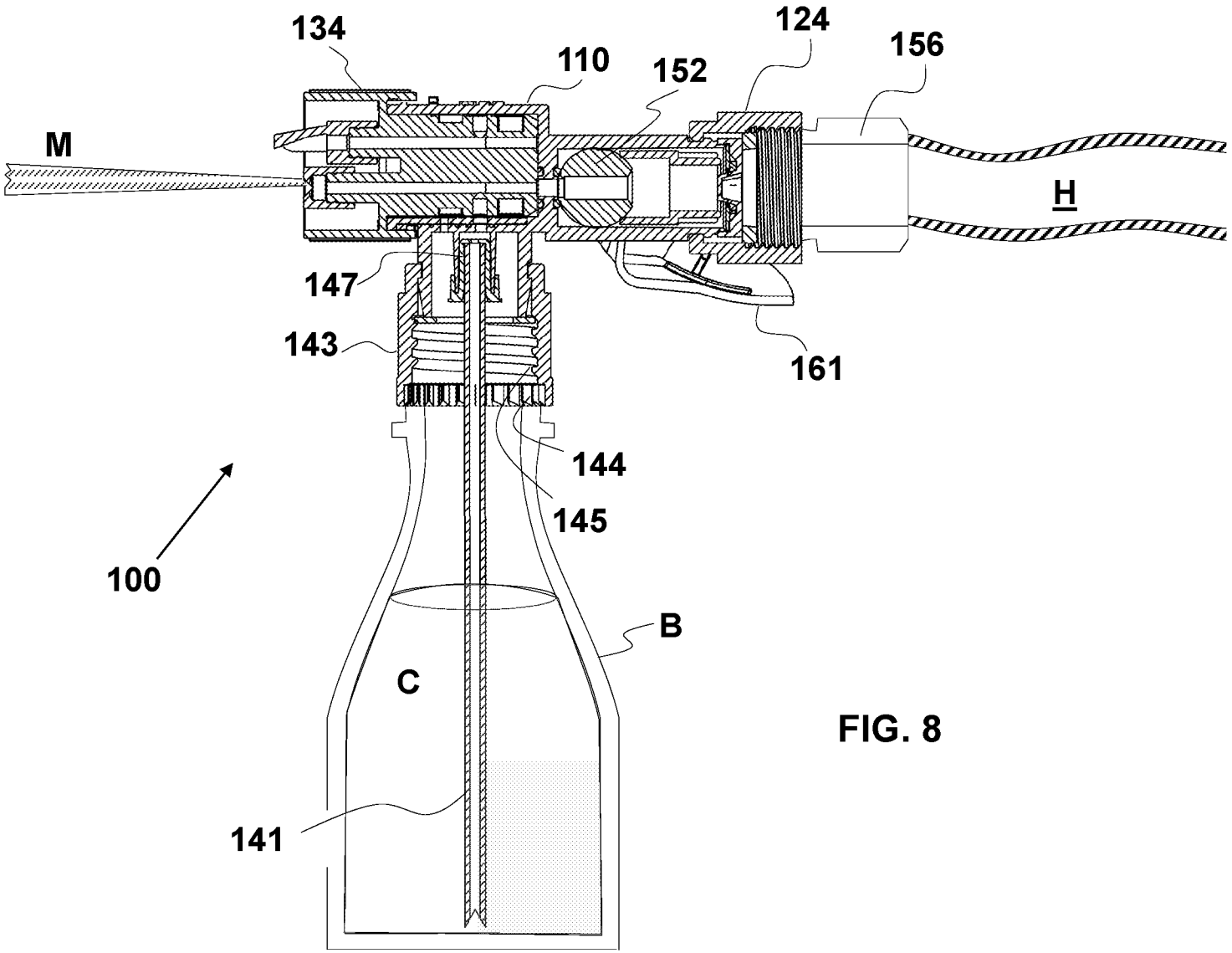
FIG. 8 illustrates a cross-section side view of a hose end sprayer connected to a bottle containing a chemical solution and with a carrier fluid hose attached to the sprayer.

FIG. 8 repeats the cross-sectional view seen in FIG. 6, this time showing a hose H with its outlet connection 156 attached to hose closure 124 for example by threaded connection. A bottle B containing a chemical C is also shown attached to closure cap 143 via threads 145. Anti-backoff provisions 144 such as ratchet teeth may be provided to prevent removing closure cap 143 from bottle B, or to increase the torque required to remove closure cap 143 from bottle B.

The hose end sprayer 100 may be formed of a material such as plastic and may be injection molded. Suitable plastics include polypropylene (PP) and other plastics. The trigger may be acetal or polybutylene terephthalate (PBT).

While preferred embodiments of the invention have been described and illustrated, it should be apparent that many modifications to the embodiments and implementations of the invention can be made without departing from the spirit or scope of the invention. It is to be understood therefore that the invention is not limited to the particular embodiments disclosed (or apparent from the disclosure) herein, but only limited by the claims appended hereto.

The invention claimed is:

1. A hose-end sprayer, comprising:

a carrier fluid inlet connection;

a carrier fluid flow control valve downstream of the carrier fluid inlet connection;

a lever that rotates the carrier fluid flow control valve, the lever and carrier fluid flow control valve being biased into a closed position by a spring;

a carrier fluid flow path that is linear along a first axis; and a turret valve downstream of the carrier fluid flow control valve having an end wall and a side wall and a first flow passage extending through said end wall that is collinear with the carrier fluid flow path in a first configuration, wherein the turret valve rotates about a third axis which is parallel to the first axis and vertically offset from the first axis, and wherein the turret valve further comprises a first chemical vent passage extending through said side wall, said first chemical vent passage being oriented perpendicular to the first axis and connected between the first flow passage and a chemical source.

2. The hose-end sprayer of claim 1, wherein the carrier fluid flow control valve comprises a spherical shape over at least a portion of its surface.

3. The hose-end sprayer of claim 1, wherein the lever and the spring are molded as a single piece.

4. The hose-end sprayer of claim 1, wherein the carrier fluid flow control valve rotates about a second axis that is perpendicular to the first axis.

5. The hose-end sprayer of claim 1, wherein the turret valve further comprises a second flow passage that is parallel to the first axis and extends through said end wall, and still further comprising a second chemical vent passage extending through said side wall, said second chemical vent passage being oriented perpendicular to the first axis and connected between the second flow passage and the chemical source.

6. The hose-end sprayer of claim 5, wherein the first flow passage includes a first spray element and the second flow passage includes a second spray element.

7. The hose-end sprayer of claim 5, wherein the turret valve has a first position, corresponding to the first configuration, in which the first flow passage is connected to the carrier fluid flow control valve, a second position in which the second flow passage is connected to the carrier fluid flow control valve, and at least one off position.

8. The hose-end sprayer of claim 7, wherein the first flow passage includes a first spray element and the second flow passage includes a second spray element.

9. The hose-end sprayer of claim 1, further comprising a metering orifice between the first flow passage and the chemical source.

10. The hose-end sprayer of claim 1, further comprising a closure for attaching to a chemical supply container.

11. The hose-end sprayer of claim 1, wherein the lever pivots upon at least one axle, and the at least one axle is attached to the carrier fluid flow control valve.

* * * * *